US005455989A

United States Patent [19]

Roy

[11] Patent Number: 5,455,989

[45] Date of Patent: Oct. 10, 1995

[54] EASEL HINGE

[75] Inventor: Armand E. Roy, Attleboro, Mass.

[73] Assignee: Craft, Inc., South Attleboro, Mass.

[21] Appl. No.: 275,299

[22] Filed: Jul. 14, 1994

[51] Int. Cl.[6] ..... E05D 1/04

[52] U.S. Cl. ..... 16/376; 16/377

[58] Field of Search ..... 16/326, 377, 380

[56] References Cited

U.S. PATENT DOCUMENTS

| | | | |
|---|---|---|---|
| 3,994,045 | 5/1976 | Roy | 16/178 |
| 4,050,117 | 7/1977 | Roy | 16/178 |
| 4,349,942 | 2/1982 | Roy | 16/376 |
| 4,979,266 | 7/1990 | Roy | 16/376 |

*Primary Examiner*—S. Thomas Hughes
*Assistant Examiner*—Kenneth J. Hansen
*Attorney, Agent, or Firm*—Salter & Michaelson

[57] ABSTRACT

An easel hinge includes an outer hinge plate and an inner hinge plate interconnected with each other for relative pivotal movement therebetween. The outer hinge plate has a relatively flat leaf portion terminating in a curled barrel at one side thereof and at least two spaced apart notches formed in the curled barrel. The inner hinge plate has a relatively flat leaf portion and at least two spaced apart lobes extending from the inner hinge plate leaf portion in a plane generally perpendicular to the plane of the inner hinge leaf portion. The lobes are received in the curled barrel of the outer hinge plate through the notches of the curled barrel for permitting relative rotational movement of the inner hinge plate with respect to the outer hinge plate. Lugs formed on the lobes limit the relative rotational movement of the hinge plates and prevent the longitudinal movement of the plates with respect to each other. The lugs permit the relative rotational movement of the hinge plates between a substantially closed position in which the leaves of the hinge plates are generally face-to-face and an open position in which the leaves of the hinge plates are separated at a desired angle of separation.

9 Claims, 3 Drawing Sheets

EASEL HINGE

BACKGROUND AND SUMMARY OF THE INVENTION

This invention relates generally to easel hinges and more particularly to an easel hinge which is adapted to be more effectively plated, such as by black oxide plating solution.

Easel hinges of the type disclosed in U.S. Pat. Nos. 3,994,045, 4,050,117 and 4,979,266, which are incorporated herein by reference, are highly effective for hingeably connecting the supporting leg of a picture frame to the backing board of the frame. The easel hinge of this type generally comprises outer and inner hinge plates, each including a substantially flat leaf portion and a rolled barrel portion which is integral with the leaf portion. The outer and inner hinge plate barrel portions are interfitted (i.e., the inner hinge plate barrel portion is captured within the outer hinge plate barrel portion) for connecting the hinge plates in a manner such that the hinge plates are movable between a closed position wherein the leaf portions are in substantially parallel, closely adjacent relation and an open position wherein the leaf portions are in angular relation. The easel hinge of this type also includes a pair of rosette fastening elements on the outwardly facing sides of the hinge plates for securing one of the hinge plates to the backing board of a picture frame and the other hinge plate to the supporting leg of the frame.

The easel hinge of the type described above is typically made from cold rolled steel and in most cases has a protective black oxide layer and/or corrosion resistant wax coating applied on the surfaces of the hinge plates for protecting the hinge from rusting. In this regard, black oxide surface layers are applied to the easel hinge by immersing it in caustic salt solutions and corrosion resistant wax coatings are applied to the hinge by immersing it in liquid baths of corrosion resistant waxes.

U.S. Pat. No. 4,979,266 discloses an easel hinge designed to prevent rusting and corrosion between main portions of the hinge plates (i.e., between the adjacent surfaces of the outer and inner leaf portions). More specifically, this patent teaches the provision of daps provided on the inwardly mating surfaces of the hinge plates which encircle apertures in the rosette fastening elements for maintaining a space between the hinge plates so that when they are immersed in black oxide plating solution or corrosion resistant waxes, the solution or wax is uniformly applied over the inner surfaces of the hinge plate thereby effectively protecting the hinge plates from rusting and corrosion.

Notwithstanding the efficacy of the daps provided in U.S. Pat. No. 4,979,266 for overcoming the problem of rusting and corrosion on the inner surfaces of the hinge plates, there is a remaining problem of the rusting of the outer and inner hinge plate barrel portions. Because of the tight, interfitted relation between the outer and inner barrel portions, it is difficult for the black oxide plating solution or corrosion resistant waxes to effectively penetrate between the entire barrel surfaces. Thus, the uncoated portions of the surfaces of the outer and inner barrel portions often have increased levels of susceptibility to rust and corrosion.

Accordingly, among the several objects of the present invention are the provision of an improved easel hinge adapted to be effectively plated by immersion in a coating or plating solution; the provision of such an easel hinge designed so that the plating solution has more effective access to the hinge portion of the easel hinge for more effective coverage of the mating surfaces of said hinge portion; the provision of such an easel hinge which is lightweight; the provision of such an easel hinge having outer and inner hinge plates interconnected with each other for relative pivotal movement and designed to easily move between a closed position in which the hinge plates are adjacent one another to an open position in which the hinge plates are separated at a desired angle of separation, the hinge plates being further designed to maintain their angle of separation in their open position and maintain their adjacent relationship in their closed position; and the provision of such an easel hinge which is of simple, low cost construction and which can be readily made and assembled by automatic equipment.

In general, an easel hinge of the present invention comprises an outer hinge plate and an inner hinge plate interconnected with each other for relative pivotal movement therebetween. The outer hinge plate has a relatively flat leaf portion terminating in a curled barrel at one side thereof and at least two spaced apart notches formed in the curled barrel. The inner hinge plate has a relatively flat leaf portion and at least two spaced apart lobes extending from the inner hinge plate leaf portion in a plane generally perpendicular to the plane of the inner hinge leaf portion. The lobes are received in the curled barrel of the outer hinge plate through the notches of the curled barrel for permitting relative rotational movement of the inner hinge plate with respect to the outer hinge plate.

Stop means limits the relative rotational movement of the hinge plates and prevents the longitudinal movement of the plates with respect to each other. The stop means permits the relative rotational movement of the hinge plates between a substantially closed position in which the leaves of the hinge plates are generally face-to-face and an open position in which the leaves of the hinge plates are separated at a desired angle of separation.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
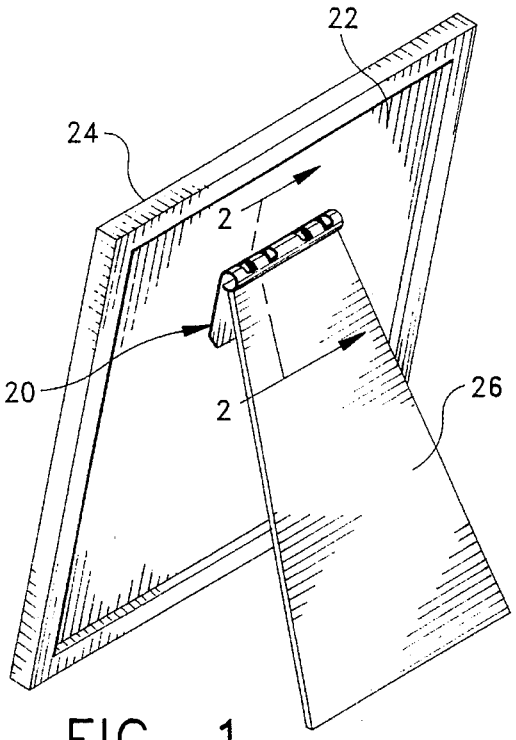
FIG. 1 is perspective view of an easel hinge constructed in accordance with the instant invention applied to an easel type picture frame.
Figure 2:
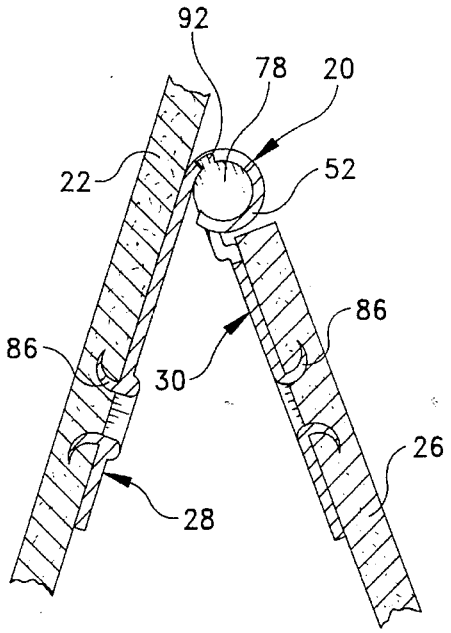
FIG. 2 is an enlarged sectional view of the easel hinge taken along line 2—2 of FIG. 1.

Referring now to the drawings, and more particularly FIGS. 1 and 2, there is generally indicated at 20 an easel hinge which serves to connect a backing 22 of a picture frame 24 to its support leg 26. The easel hinge 20 comprises a substantially planar outer hinge plate generally indicated at 28, a substantially planar and inner hinge generally indicated at 30, both made from any suitably stiff but workable material such as sheet metal. Preferably, the easel hinge 20 is provided with a protective black oxide layer and/or corrosion resistant wax coating applied on the surfaces of the hinge plates for protecting the hinge from rusting. The outer and inner hinge plates 28, 30 are interconnected for relative arcuate movement between a substantially closed position in which the hinge plates 28, 30 are generally adjacent one another and an open position in which the hinge plates are separated at a desired angle of separation which is suitable for supporting the picture frame 24.

Figure 3:
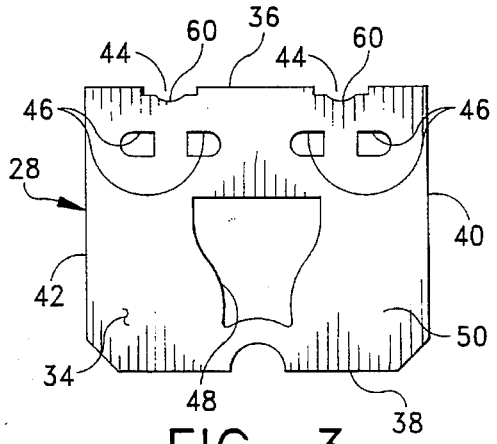
FIG. 3 is a front elevation view of an outer hinge plate of the easel hinge in a flattened condition, prior to bending and stamping operations.
Figure 5:
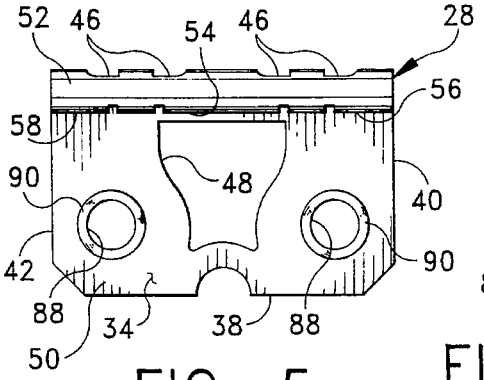
FIG. 5 is a front elevation view of the outer hinge plate after the bending operation.
Figure 6:
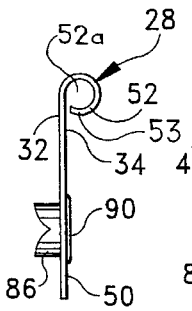
FIG. 6 is a side elevation view thereof.
Figure 7:
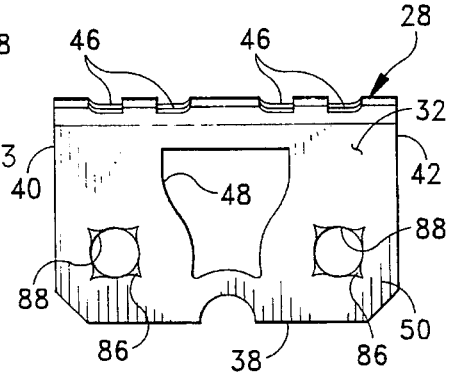
FIG. 7 is a rear elevation view thereof.
Figure 8:
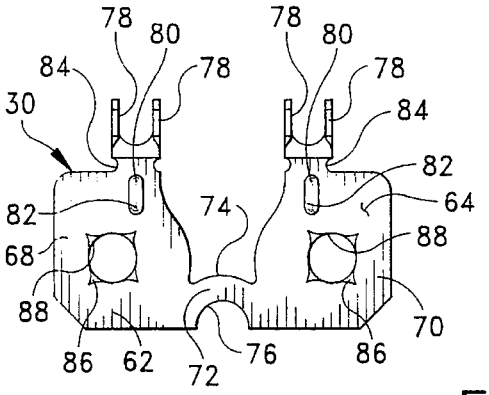
FIG. 8 is a front elevation view of the inner hinge plate after the bending operation.
Figure 9:
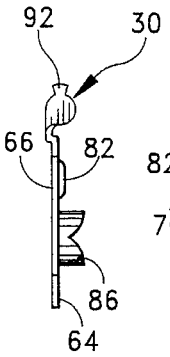
FIG. 9 is a side elevation view thereof.
Figure 10:
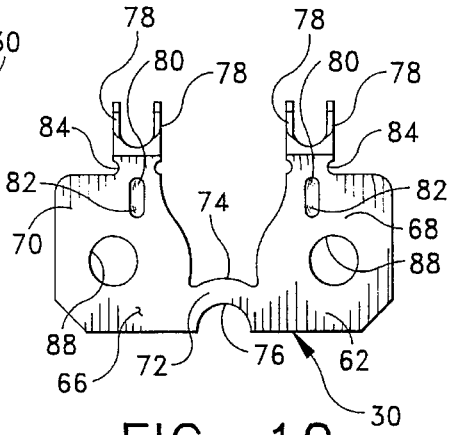
FIG. 10 is a rear elevation view thereof.
Figure 11:
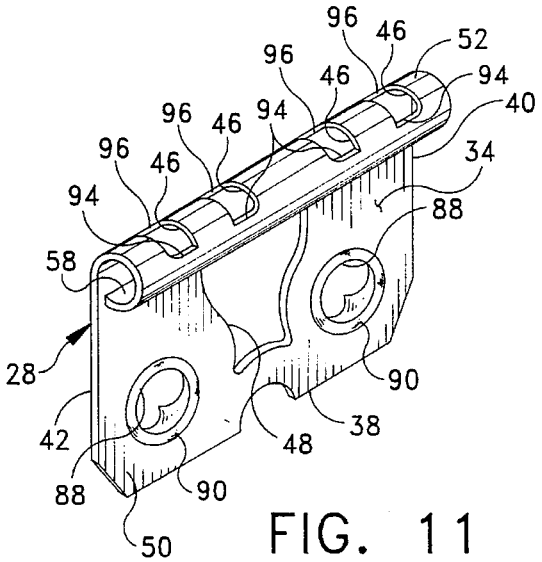
FIG. 11 is a perspective view of the outer hinge plate illustrated in FIGS. 5–7.
Figure 12:
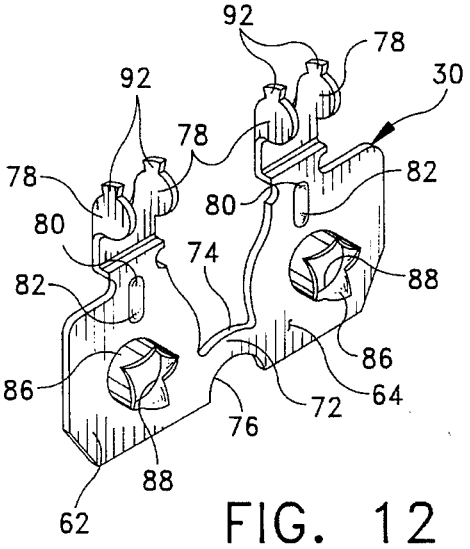
FIG. 12 is a perspective view of the inner hinge plate illustrated in FIGS. 8–10.
Figure 13:
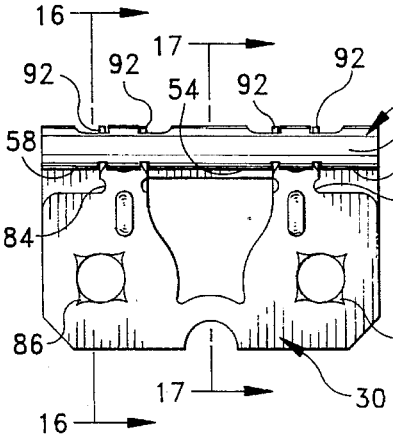
FIG. 13 is a front elevation view of the easel hinge of the present invention in assembled condition.
Figure 14:
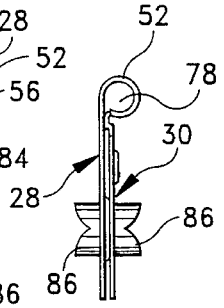
FIG. 14 is a side elevation view thereof.
Figure 15:
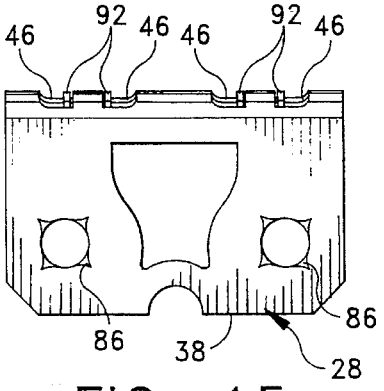
FIG. 15 is a rear elevation view thereof.

The construction of the generally rectangular-shaped (in its pre-bend configuration) outer hinge plate 28 is best illustrated with reference to FIGS. 3, 5—7 and 11 wherein the outer hinge plate has an outer surface 32, an inner surface 34, two long sides 36, 38 and two short ends 40, 42. As illustrated in FIG. 3, the outer hinge plate 28, before being subjected to a bending operation, has a pair of notches each indicated 44 formed along a longitudinal free edge (side 36), four aligned openings each indicated 46 spaced below the notches 44, and a relatively large central opening 48 located below the four openings 46. The outer hinge plate 28 may be formed by stamping the sheet metal material, for example. FIGS. 5–7 and 11 illustrate the outer hinge plate 28 after it is bent by suitable means, such as by progressively feeding the stamped sheet metal into a closed curved die which is disclosed in U.S. Pat. No. 3,994,045. As shown, after being bent, the outer hinge plate 28 has a relatively flat leaf portion 50 which terminates at side 36 in a curled barrel 52 defining a transversely extending pivot axis 52*a*. The terminal edge 53 of barrel 52 is spaced slightly from surface 34 as shown most clearly in FIG. 6. Specifically, said terminal edge consists of three closed barrel portions or tongues, the middle or inner tongue being designated 54 and the two outer tongues being designated 56, 58. Top edges 60 (FIG. 3) of the notches 44 are spaced away from the inner surface 34 of the outer hinge plate leaf. The four openings 46 are located at the top of the curled barrel 52, and the large opening 48 is centrally located within the leaf portion 50 as illustrated in FIGS. 5–7.

Figure 4:
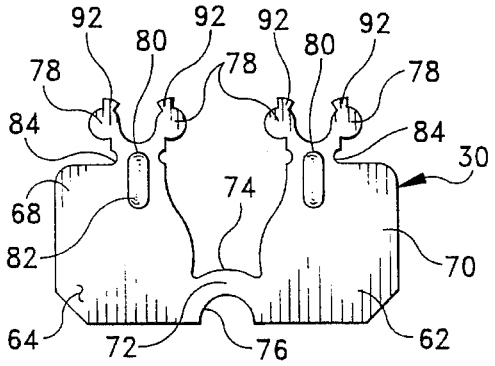
FIG. 4 is a front elevation view of an inner hinge plate of the easel hinge in a flattened condition, prior to bending and stamping operations.

Referring now to FIGS. 4, 8–10 and 12, the construction of the inner hinge plate 30 is best seen as comprising a relatively flat leaf portion 62 having an outer surface 64, an inner surface 66, a left-hand section 68 and a right-hand section 70. The left-hand and right-hand sections 68, 70 are interconnected by an integral web section 72. A channel 74 formed above the web section 72 and between the two sections 68, 70 and a cut-out 76 formed below the web section 72 divide the left-hand and right-hand sections 68, 70. At the upper ends of each section 68, 70, there is provided two generally circular lobes, each indicated 78, which are bent relative to the flat leaf portion 62 in a plane generally perpendicular to the plane of the leaf portion (FIGS. 8–10 and 12) and generally perpendicular to axis 52*a* when the plates 28 and 30 are in assembled relation. In its pre-bend configuration, the inner hinge plate 30 (including the leaf portion 62 and lobes 78) is completely flat (FIG. 4). Each lobe 78 is connected to its respective leaf portion by means of a connection web 80. More particularly, there is a web 80 connecting the two left-hand lobes 78 to the left-hand section 68 and another web 80 connecting the two right-hand lobes 78 to the right-hand section 70. Reinforcing ribs 82 integrally formed in the leaf portion 62 reinforce and strengthen the webs 80. A pair of notches, each indicated 84, one formed in the left-hand section 68 adjacent to the left-hand web 80 and the other formed in the right-hand section 70 adjacent the right-hand web 80, are further provided and will be discussed in greater detail hereinafter.

The outer and inner hinge plates 28, 30 are each provided with a pair of rosette fastening elements each indicated 86 formed (i.e., by stamping) in respective leaf portions 50, 62 for securing the outer hinge plate 28 to the backing 22 of the picture frame 24, and the inner hinge plate 30 to the support leg 26. Each rosette fastening element 86 has a central aperture 88 formed in the leaf portion of the hinge plate, the element 86 projecting outwardly from a respective outer surface 32, 64 of the leaf portion 50, 62 for fixedly engaging the respective backing 22 and or support leg 26. These rosette fastening elements 86 are of the type disclosed in U.S. Pat. Nos. 3,994,045, 4,050,117 and 4,979,266, and reference should be made to these patents for details of their construction.

For ensuring the inner surfaces 34, 66 of the outer and inner hinge plate leaf portions 50, 62, respectively, are adequately covered with wax coating or black oxide plating solution, dap means comprising a dap 90 which encircles each aperture 88 of the rosette fastening element 86 is provided. The daps 90 are on the inner surface 34 of the outer hinge plate 28. The daps 90 maintain the leaf portions 50, 62 in a spaced relation (albeit slightly spaced) when the hinge plates 28, 30 are in their closed position. This construction is specifically taught in U.S. Pat. No. 4,979,266 which as stated above is incorporated herein by reference.

Referring now to FIGS. 13–17, the lobes 78 of the inner hinge plate 30 are received in the curled barrel 52 of the outer hinge plate 28 through the notches 44 for permitting relative rotational movement of the inner hinge plate 30 with respect to the outer hinge plate 28. The hinge plates 28, 30 are interconnected by performing the bending operation of the outer hinge plate 28 with the inner hinge plate 30 in position such that the lobes 78 are captured within the curled barrel 52. The lobes 78 frictionally engage the inner surfaces of the curled barrel 52 to provide a desired frictional drag as the hinge plates 28, 30 move with respect, to each other, while enabling the movement of the hinge plates 28, 30 with respect to each other when a nominal force is applied thereto. In this regard, it should be noted that the easel hinge of the present invention is capable of being moved more easily to its open position than prior art easel hinges. This is due to the fact that there is less friction between the lobes 78 and the curled barrel 52 than there is between the inner and outer curled barrels of the prior art hinges.

More specifically, the inner tongue 54 of the curled barrel 52 is aligned with and projects through the inner hinge plate leaf channel 74 and the outer tongues 56, 58 are aligned with and project through the notches 84 of the inner hinge plate 30. The sides of the inner tongue 54 engage sides of the channel 74 of the inner hinge plate 30 for assisting in preventing longitudinal movement of the inner hinge plate 30 with respect to the outer hinge plate 28. Likewise, sides of the outer tongues 56, 58 engage the webs 80 for assisting in preventing such longitudinal movement.

As stated above the curled barrel 52 receives the lobes 78 of the inner hinge plate 30 for allowing the rotational movement of the inner hinge plate 30 with respect to the outer hinge plate 28. The top edge 60 of each notch 44 of the outer hinge plate 28 engages its respective connecting web 80 of the inner hinge plate 30 when the hinge plates are in their open position. The hinge plates 28, 30 are thereby prevented from separating beyond a desired angle of separation upon the webs 80 contacting the edges of the notches 44. Thus, for example, by forming deeper notches in the outer hinge plate 28, the angle of separation is increased.

Figure 16:
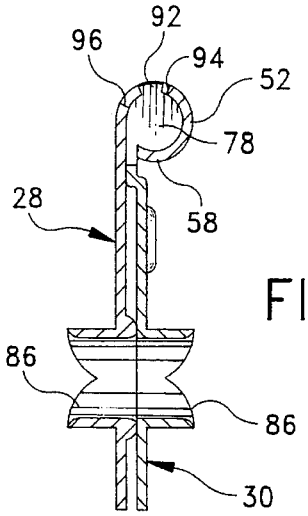
FIG. 16 is an enlarged sectional view taken along line 16—16 of FIG. 13.
Figure 16A:
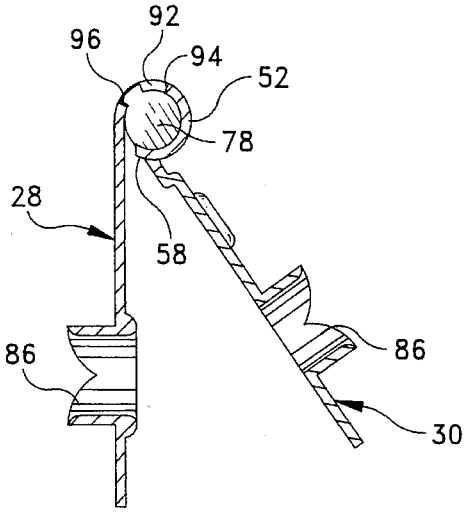
FIG. 16A is a view-similar to FIG. 16 but with the easel hinge in its open position.
Figure 17:
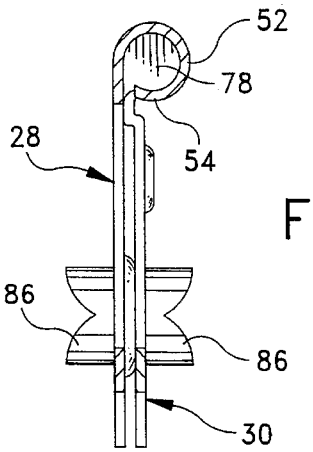
FIG. 17 is an enlarged sectional view taken along line 17—17 of FIG. 13.
Figure 17A:
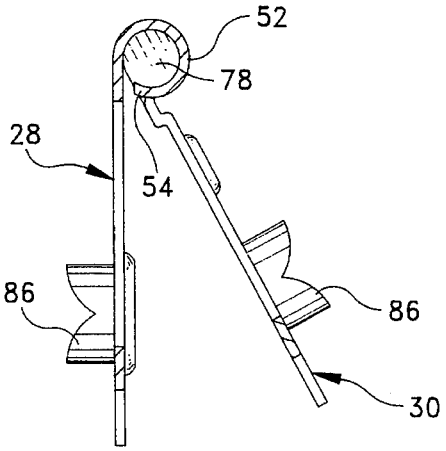
FIG. 17A is a view similar to FIG. 17 but with the easel hinge in its open position.

Although the overextension of the hinge plates 28, 30 may be prevented by the engagement of the webs 80 of the inner hinge plate 30 with the edges 60 of respective notches 44 of the outer hinge plate 28, stop means associated with the lobes 78 further prevents such overextension. More specifically, the stop means comprises, for each lobe 78, a lug 92 projecting from the lobe 78 which extends through the openings 46 provided in the curled barrel 52 of the outer hinge plate 28. Each lug 92 is moveable within its respective opening 46 when moving the hinge plates 28, 30 with respect to each other (see FIGS. 16 and 16A). When the hinge plates 28, 30 are in their substantially closed position, the lugs are positioned adjacent an end edge 94 (FIG. 11) of each opening 46 and when the hinge plates are in their open position, the lugs 92 are positioned adjacent an opposite end edge 96 (FIG. 11) of each opening. Thus, upon overextending the hinge plates 28, 30, the lug 92 of each lobe 78 engages end 96 of its respective opening 46. The lugs 92 also engage side edges of the openings 46 for assisting in preventing the longitudinal movement of the plates 28, 30 with respect to each other.

It should be noted that the above description of the preferred embodiment of the invention is especially suited for effectively covering outer surfaces of the easel hinge 20 when the hinge is immersed in a coating or plating solution. More specifically, the hinged connection (i.e., curled barrel 52 receiving lobes 78) of outer and inner plates 28, 30 is especially effective when immersing the hinge 20 in a coating or plating solution so that surfaces of the hinged connection are exposed to the coating or solution. By providing four lobes 78 instead of a curled inner barrel (which was disclosed in the above-identified patents) for connecting the curled barrel 52 of the outer hinge plate 28 to the inner hinge plate 30, the interior surfaces of the curled barrel 52 are exposed for effective coating. The four lobes 78 occupy little space in the curled barrel 52 thereby enabling coating or plating solution to flow through the ends of the curled barrel and through the notches 44 and the openings 46 provided in the barrel 52. Complete and adequate coverage of the interior surfaces of the curled barrel by the plating solution are ensured for preventing rusting or corrosion.

It should also be noted that the easel hinge 20 of the present invention is lighter than the prior art easel hinges because of the material removed to form the notches 44, openings 46 and large central opening 48 of the outer hinge plate 28 and the channel 74, cut-out 76 and notches 84 of the inner hinge plate 30. While lighter than the prior art easel hinges, the easel hinge 20 of the present invention is equally as strong and durable as the prior art hinges.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An easel hinge comprising an outer hinge plate, an inner hinge plate interconnected with the outer hinge plate for relative pivotal movement therebetween, said outer hinge plate having a relatively flat planar leaf portion terminating in a curled barrel at one side thereof, said curled barrel defining a pivot axis extending transversely of said outer hinge plate, said curled barrel having a terminal edge slightly spaced from said relatively flat planar leaf portion, and at least two spaced apart notches formed in said terminal edge in the curled barrel, said inner hinge plate having a relatively flat planar leaf portion and at least two spaced apart generally circular lobes extending from the inner hinge plate leaf portion in a plane generally perpendicular to said pivot axis, said lobes being an integral extension of said inner hinge leaf portion whereby the thickness of the at least two lobes is the same as the thickness of said inner hinge leaf portion, said at least two lobes being snugly and rotatably received within said curled barrel in positions aligned with said at least two notches, thus permitting relative rotational movement between said inner and outer hinge plates.

2. The easel hinge as set forth in claim 1 further comprising stop means for limiting the relative rotational movement of the hinge plates, said stop means permitting said relative rotational movement of the hinge plates between a substantially closed position in which the leaves of the hinge plates are generally face-to-face and an open position in which the leaves of the hinge plates are separated at a desired angle of separation.

3. The easel hinge as set forth in claim 2 wherein said stop means comprises a lug provided on each of said at least two lobes, and openings, one for each lug, formed in the curled barrel for receiving the lug of a lobe therein, each lug being moveable within its respective opening when moving the hinge plates with respect to each other such that when said hinge plates are in their substantially closed position, the lug is positioned adjacent one end edge of the opening and when said hinge plates are in their open position, said lug is positioned adjacent an opposite end edge of the opening and engages said opposite end edge for preventing further rotational movement of the hinge plates with respect to each other.

4. The easel hinge as set forth in claim 3 wherein each lug engages a side edge of the opening for preventing longitudinal movement of the plates with respect to each other.

5. The easel hinge as set forth in claim 1 wherein said at least two lobes frictionally engage inner surfaces of the curled barrel for providing some degree of frictional drag as the hinge plates move with respect to each other.

6. The easel hinge as set forth in claim 1 wherein said inner hinge plate leaf portion has at least one channel formed therein adjacent said curled barrel of the outer hinge plate, said curled barrel terminal edge having at least one portion thereof closely adjacent said inner surface to define a closed barrel portion, the remaining portions thereof being spaced from said inner surface to define said notches through which the lobes extend, said closed barrel portion being aligned with and projecting through said inner leaf channel.

7. The easel hinge as set forth in claim 6 wherein each of said at least two lobes of the inner hinge plate is connected to said inner hinge plate leaf portion by means of a connection web, an edge of each of said at least two notches of the outer hinge plate contacting its respective connecting web of the inner hinge plate when the hinge plates are in their open position.

8. The easel hinge as set forth in claim 7 wherein said inner leaf channel is centrally disposed, said closed barrel portion of the outer barrel comprising a tongue projecting through said inner leaf channel, said tongue having opposed sides thereof disposed proximal to sides of said inner leaf channel.

9. The easel hinge as set forth in claim 6 wherein said inner hinge plate leaf portion includes a pair of additional notches at respective ends thereof, said closed barrel portion of the outer barrel comprising tongues aligned with respect to said pair of additional notches for projection-therein.

* * * * *